United States Patent [19]

Asari et al.

[11] Patent Number: 4,727,925

[45] Date of Patent: Mar. 1, 1988

[54] ENDLESS TRACK CONTINUOUS CASTING MACHINE

[75] Inventors: Takashi Asari, Takarazuka; Takashi Okazaki, Ibaraki; Masakazu Koide, Chiba, all of Japan

[73] Assignees: Sumitomo Heavy Industries, Ltd., Tokyo; Sumitomo Metal Industries, Ltd., Osaka, both of Japan

[21] Appl. No.: 866,649

[22] Filed: May 27, 1986

[30] Foreign Application Priority Data

Mar. 28, 1986 [JP] Japan ..... 61-70445

[51] Int. Cl.[4] ..... B22D 11/06

[52] U.S. Cl. ..... 164/431; 164/481

[58] Field of Search ..... 164/431, 430, 432, 481

[56] References Cited

U.S. PATENT DOCUMENTS 4,620,583 11/1986 Koide et al. ..... 164/430 X

FOREIGN PATENT DOCUMENTS 56-154263 11/1981 Japan ..... 164/430

60-49841 3/1985 Japan .

*Primary Examiner*—Nicholas P. Godici

*Assistant Examiner*—J. Reed Batten, Jr.

*Attorney, Agent, or Firm*—Armstrong, Nikaido, Marmelstein & Kubovcik

[57] ABSTRACT

An endless track continuous casting machine having a pair of upper and lower endless belts facing each other in a spaced apart relationship and travelling in a downwardly slanted direction which form the long side walls of a mold. Dam blocks continuously and closely disposed and pinched between both side edges of the pair of endless belts and each supported by a link forming part of an endless chain wound around sprockets disposed on each side of the pair of endless belts form the short side walls of the mold. The dam blocks are mounted on each of the links of the endless chain to be movable inwardly and outwardly, and they are guided by a guiding mechanism to a projecting position when entering the advancing path of the mold and are guided to a set back position when entering the returning route. This guiding mechanism is adjustable to change the projected position of each dam block while the endless chain is moving, thus enabling the width of a cast piece to be altered without stopping the casting work.

8 Claims, 11 Drawing Figures

ENDLESS TRACK CONTINUOUS CASTING MACHINE

BACKGROUND OF THE INVENTION

1. Field of the Invention

The present invention relates to an endless track continuous casting machine having cast piece casting molds which continuously travel while being slanted downwardly.

Endless track casting machines have conventionally been of the following types: a moving side dam type in which long side walls of a mold region are formed by upper and lower endless belts and short side walls which determine the width of cast pieces are formed by a plurality of rectangular blocks called dam blocks in the form of a string of beads which are pinched and supported between edges of the upper and lower endless belts and which are moved with these belts; and a fixed side dam type in which a short side wall of a mold is fixed and upper and lower belts are moved in slidable relationship with the short side walls. The present invention relates specifically to the moving side dam type of endless track continuous casting machine.

2. Description of the Prior Art

Both of these two types of conventional endless track continuous casting machines involve a step of stopping the casting work in order to allow the transverse position of the two short side walls which constitute a mold to be rearranged to alter the width of the cast piece and thereafter restarting the work. Thus, these conventional methods can not attain a high productivity.

SUMMARY OF THE INVENTION

It is therefore an object of the present invention to provide an endless track continuous casting machine which for the purpose of solving the above problem, is arranged to enable the width of a cast piece to be altered by moving side dams in the transversal direction while casting work is continuing.

In the endless track continuous casting machine according to the invention, endless chains wound around a pair of sprockets rotating around shafts perpendicular to the surfaces of upper and lower endless belts constituting the long side walls of a mold are disposed at both sides of the endless belts; each of the dam blocks which constitutes the short side walls of the mold is mounted on a link of the endless chain through guide rods such as to be movable inwardly and outwardly; guide members guide the dam blocks to the outer position through the advancing route of the endless chain and to the inner position through the returning route of the same; and the guiding members are controllable such that the outer position of the dam blocks can be altered while the endless chains are travelling.

However, there are some problems in the practical application of the endless track continuous casting machine as described above. That is, since the dam blocks are attached to the links of the endless chain, play due to abrasion is caused at the position of the connecting pins of the links after a long period of service. The pitch of each link is thereby increased such as to form a gap between dam blocks into which molten metal penetrates. This results in the side surface of a cast piece being given an undesirable configuration.

Secondly, it is necessary to return the dam block to the inner position when, after passing through the advancing route, it turns with the sprocket before entering the returning route. This movement is effected by engaging the front surface of the dam block with a sequence of guide rolls which are disposed around the sprocket such as to gradually come close to the center of the sprocket. However, poor condition and abrasion of the guide roll will impede the smooth turning of the dam blocks and causes trouble in moving the dam blocks in synchronized relationship with the movement of the upper and lower endless belts.

Thirdly, when, during casting work, the dam blocks are moved such as to make narrower the width of a cast piece, the surfaces of neighboring dam blocks are staggered such that the dam block on the upper stream side is pushed further inward in the widthwise direction of the cast piece. A similar staggered relationship is caused on the side surface of the cast piece. On the other hand, when the dam blocks which have moved parallel with the endless belt toward the exit opening start their turning movement, there is an abrupt increase in speed of the dam blocks as compared with the speed of the moving cast piece, but they are prevented from speeding up because they strike the corners formed by the staggered surfaces of the cast piece. Thus, there is a risk of the dam block being broken by excessive stress.

It is therefore another object of the present invention to eliminate these defects as stated above. To this end, the present invention provides in one of its aspects an endless track continuous casting machine including a toothed wheel which has a tooth profile conforming to guide rods for connecting each dam block to the corresponding link of the endless chain, which rotates at a tangential velocity higher than that of the endless belts, and which is located on the passage of the guide rods in the position immediately before that where the dam block is pinched between the endless belts on the inlet side of the mold.

The present invention provides in another of its aspects an endless track continous casting machine including a dam block pushing means which pivotally moves in linked relationship with a sprocket located on the outlet side of the mold and which engages with the front surface of each dam block revolving with the sprocket after being released from the upper and lower endless belts, thus pushing the dam block to the setback position.

The present invention provides in still another of its aspects an endless track continuous casting machine, in which a chain guide on which rollers mounted on each link of the endless chain roll on the advancing route of the endless chain is slanted near the mold outlet in the direction such as to deviating far from the center line of the mold; and the rotating shaft of the outlet side sprocket is shifted such that each link engages with the outlet side sprocket on the production of the slanted surface.

DESCRIPTION OF THE PREFERRED EMBODIMENTS

Figure 1:
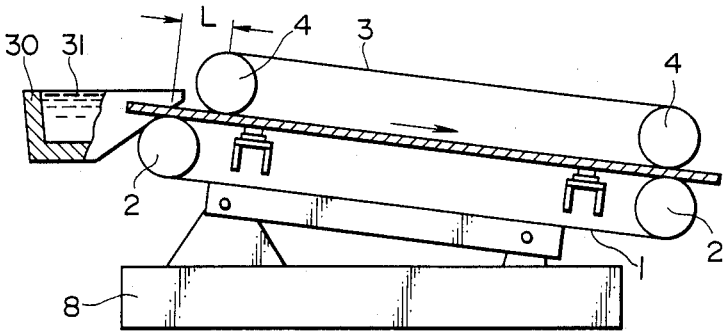
FIG. 1 PRIOR ART
FIGS. 1 and 2 are a side elevation and a plan view schematically showing an endless track continuous casting machine of a moving side dam type to which the present invention is applied.

FIG. 1 schematically shows a track type continuous casting machine to which the present invention is applied and in which a lower endless belt 1 is stretched over pulleys 2 and an upper endless belt 3 is stretched over pulleys 4 in parallel relationship with the lower endless belt 1. The pulleys 2 and 4 are mounted on a support 8 such as to give the belts 1 and 3 a falling gradient in one direction and are rotated by a driving means (not shown) such as to make both belts run in the same direction at the same speed. A container 30 in which a quantity of molten metal 31 is contained is placed at the higher ends of the belts 1 and 3. The upper belt 1 is shorter than and set back from the lower belt by a length L at its higher end.

Figure 2:
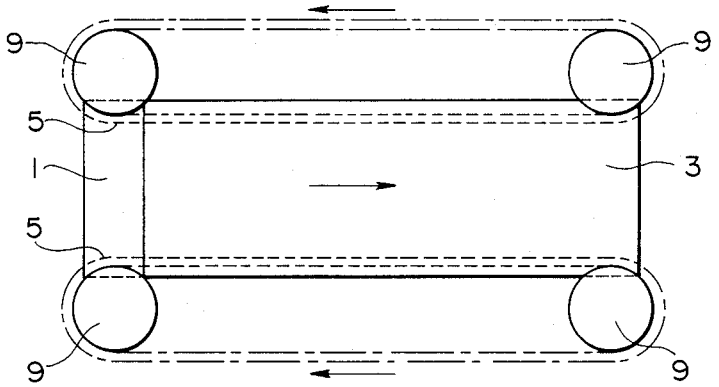
FIG. 2 PRIOR ART

As shown in FIG. 2 which is a plan view of this machine, a pair of sprockets 9 rotating around axes perpendicular to the surfaces of the upper and lower belts 1 and 3 are disposed on each side of the upper and lower belts 1 and 3, and dam blocks 5 which are attached to each of the links which constitute an endless chain stretched over these sprockets are pinched and supported between side edges of the upper and lower belts 1 and 3. The dam blocks 5 run with these upper and lower belts 1 and 3 in the direction indicated by the arrow and form the side walls of a movable mold.

Figure 3:
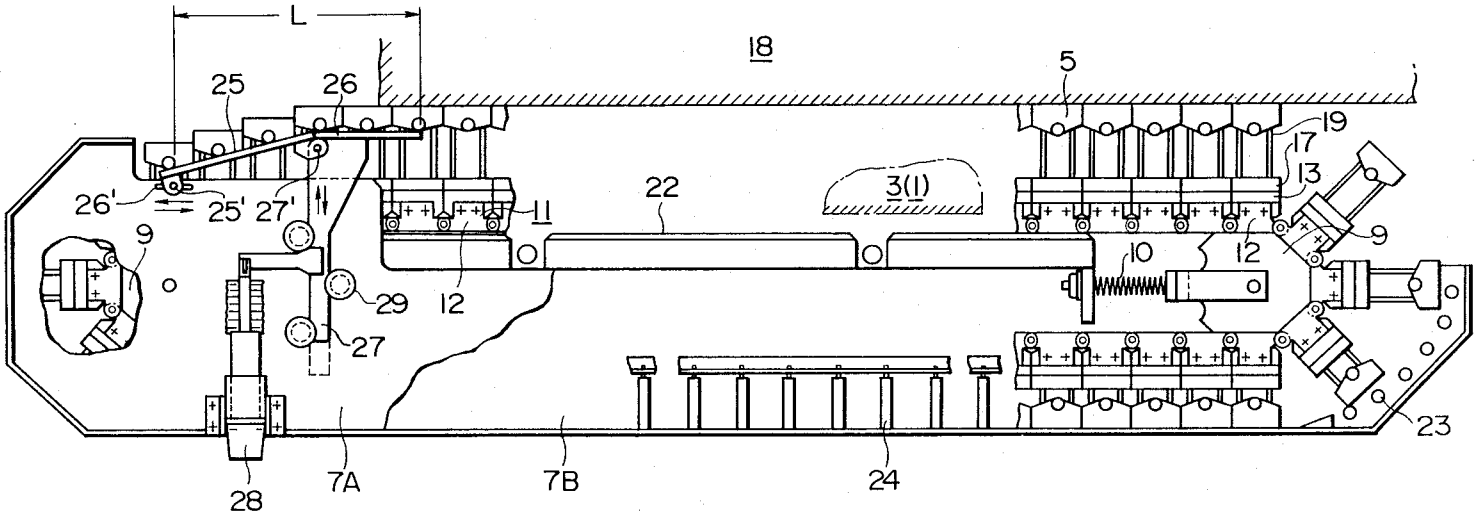
FIG. 3 is a detailed sectional plan view of one embodiment of the present invention which illustrates the driven dam blocks.
Figure 5:
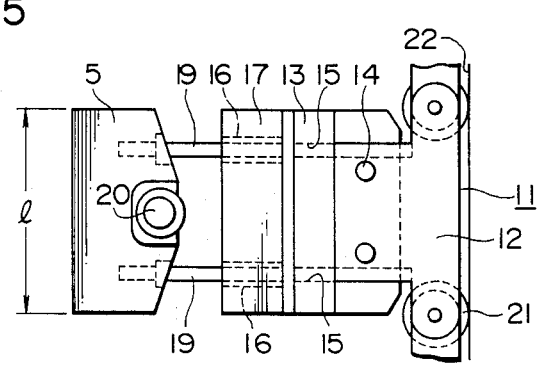
FIGS. 5 and 6 are a plan view and a partially sectional side elevation of a chain link on which dam blocks are mounted.
Figure 6:
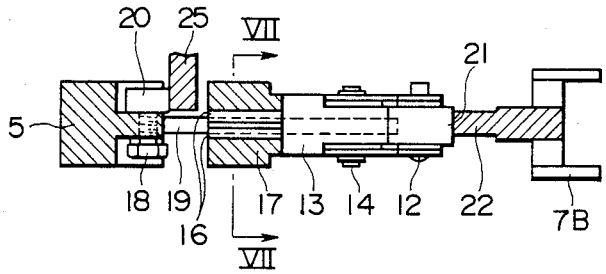
Figure 7:
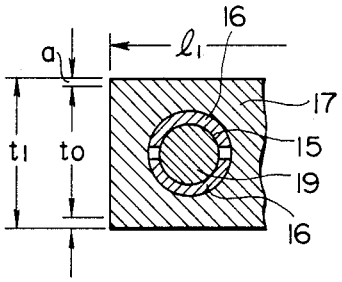
FIG. 7 is a sectional view taken along a line VII —VII of FIG. 6.

FIG. 3 shows in detailed plan the endless chain to which the dam blocks 5 are attached. As shown in FIG. 3, the sprocket 9 located at the mold outlet side is supported by a stretching spring 10 such as to be movable back and forth in the advancing direction of the mold. Each of the links 12 forming the endless chain 11 is, as shown in magnified drawings FIGS. 5 and 6, constituted by two T-shaped plates, while rollers 21 rotatable around pins which are attached to both ends of each of these plates and which connect these T-shaped plates to those constituting neighboring links are interposed between these two T-shaped plates. A guide rod bearing 13 is interposed between the raised portions of the two T-shaped plates and fixed thereto by pins 14. The guide rod bearing 13 has two holes 15 into which two guide rods 19 projecting from the rear surface of each dam block 5 are slidably inserted. Double-split resilient sleeves 16 (refer to FIG. 7) having holes corresponding to the upper production of the holes 15 are fixed to the guide rod bearing 13. A rubber seal 17 having apertures into which the resilient sleeves 16 are fittingly inserted is attached to the guide rod bearing 13. Thus, the guide rods 19 penetrate through and fit within the resilient sleeves 16, and the holes 15 of the guide rod bearing 13. A guide roller 20 is mounted on the rear side of each dam block 5 at the center thereof, and the shaft of the guide roller 20 is fixed by means of a nut 18. The guide roller 20 is positioned such that it does not protrude above the upper surface of the dam block 5, and it rolls on guide rails 25 and 26 which will be described later. The thickness $t_1$ of the rubber seal 17 is set to be larger than the thickness $t_0$ of the dam block 5 so as to allow a compressing margin a, and the length $l_1$ of the rubber seal 17 is substantially equal to the length l of the dam block 5.

Figure 4:
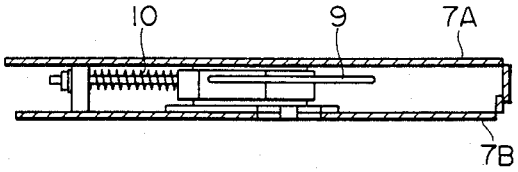
FIG. 4 is a side sectional elevation of a dam block cassette frame in which an outlet side sprocket is accommodated.

As shown in FIGS. 3 and 4, a dam block cassette frame consisting of an upper cover 7A and a lower cover 7B accommodates a group of component parts including the sprockets 9, the endless chain 11 turning around these sprockets, and dam blocks 5 attached to links 12 of this chain. Chain guides 22, guide rollers 23 and supporting rollers 24 are disposed on the lower cover 7B. The chain guides 22 guide the roller 21 of each link 12. The guide rollers 23 guide the front surface of each dam block 5 (a surface which forms a part of the side surface of the mold) when the dam blocks 5 turn around the outlet side sprocket 9 and enter the returning route, and the supporting rollers 24 guide the lower surface of each dam block on the returning route.

A slanted guide rail 25 and a parrallel guide rail 26 on which the guide roller 20 of each dam block 5 is guided and rolled are disposed on the cassette frame upper cover 7A on the mold inlet side. The parallel guide rail 26 is fixed to the top of a moving member 27 which is guided by guide rollers 29 and moved back and forth in the transverse direction of the mold by a driving means 28 such as a hydraulic cylinder, etc. The slanted guide rail 25 has at its one end a pin 25' sliding in a slot 26' formed in the upper cover 7A in the longitudinal direction thereof, and the other end of the slanted guide rail 25 is pivotally attached to the top of the moving member 27 by means of a pin 27' , thus forming a guiding surface which substantially continues to one end of the parallel guide rail 26. The other end of the parallel guide rail 26 extends to the mold section which includes a center line of the pulley 4 for the upper belt 3, that is, to the inlet area of the mold defined by the upper belt 3 and the lower belt 1.

The endless track continuous casting machine thus constituted has the function described in the following. When the dam block which has been in the setback position on the returning route turns around the inlet side sprocket 9 and reaches one end of the slanted guide rail 25, the guide roller 20 rolls on the guide rail 25 and gradually advances in the transverse direction of the mold while pulling the guide rods 19 out of the bearing holes 15. The guide roller 20 tranships from the slanted guide rail 25 to the parallel guide rail 26 and starts the parallel movement toward the mold inlet, where the dam block 5 is fully projected outwardly. When the dam block 5 is pinched between the upper and lower belts 1 and 3, the rubber seal 17 is compressed by the upper and lower belts 1 and 3. The resilient sleeves 16 are thereby bent, and they strongly pinch and support the guide rods 19, thus preventing the dam block 5 from being set back by the pressure of molten metal in the mold. The rubber seal 17 closely contacts the surfaces of the upper and lower belts 1 and 3, and the chain link 12 is thereby driven, so that the dam block 5 travels with the upper and lower belts 1 and 3 to the mold outlet while the rollers 21 roll on the chain guides 22. At the mold outlet, the dam block 5 is released from the upper and lower belts and is revolved by the outlet side sprocket 9. Since, when revolving, the guide rods 19 of the dam block are freely movable after being released from being pinched by the resilient sleeve, the dam block 5 is set back into the returning route while successively abutting at its front surface against the sequence of guide rollers 23. On the returning route, the dam block 5 is guided by the supporting rollers 24 while contacting these rollers at its lower surface. After passing through the returning route, it is revolved by the inlet side sprocket 9 again and is introduced to the slanted guide rail 25.

The above-described arrangement is specifically advantageous in that the width of a cast piece to be cast can be readily and positively altered by actuating the driving means 28 and moving the moving member 27 during the course of casting work such as to change the position of the parallel guide rail 26 in the transverse direction of the mold. In FIG. 3, a numeral 18 denotes the cast piece. The speed $V_g$ with which the width of the cast piece is altered, namely, the moving velocity of the parallel guide rail 26, may be set such as to satisfy the following formulas, the length of the dam block 5 being assumed to be l; the height of the same h; and the casting speed, namely, the advancing velocity of the mold $V_c$.

$$h/V_g > l/V_c$$

Therefore, $V_g < V_c \cdot h/l$

However, it is more preferable to improve the above described arrangement in a manner such as now described.

Figure 8:
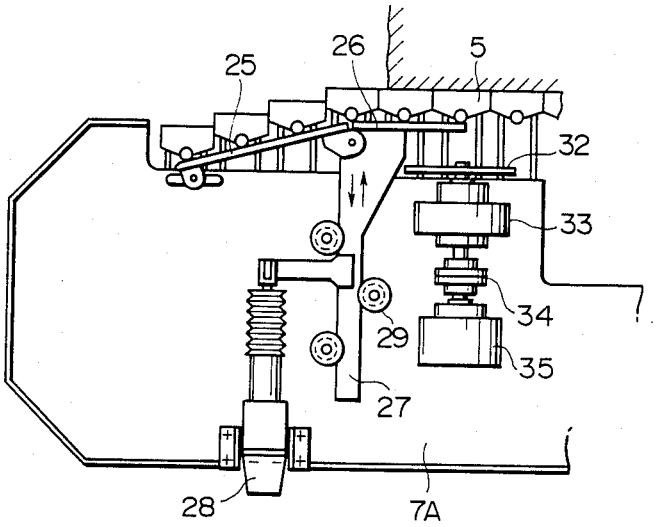
FIG. 8 is a plan view of another embodiment in which a casting machine according to the present invention is improved in structure on the mold inlet side.
Figure 9:
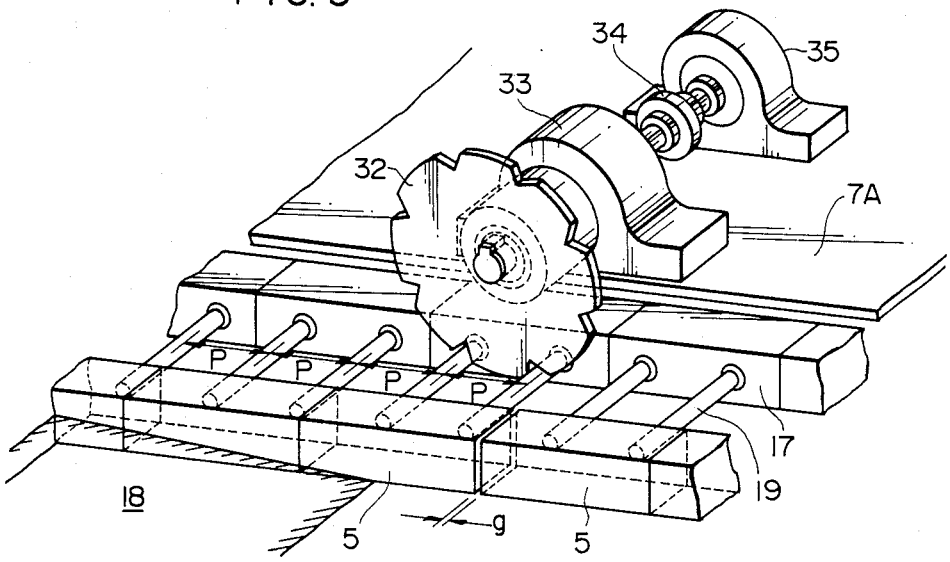
FIG. 9 is a perspective view of the same embodiment.

FIGS. 8 and 9 show an arrangement for preventing a gap from being formed between neighboring dam blocks because of play or abrasion caused on the chain link connecting pins, while the dam blocks travels on the advancing route. This arrangement includes a toothed wheel 32 whose teeth has a pitch equal to the pitch P of the guide rods 19 of the dam block 5. The toothed wheel 32 engages with the guide rods 19 functioning as a pin rack, and the rotational torque of a torque motor 35 is transmitted to the toothed wheel 32 through a coupling 34 and a speed reducer 33. Since the tangential velocity $V_t$ of the toothed wheel 32 is set to be slightly higher than the casting speed, namely, the moving velocity of the dam block 5, the succeeding dam block 5 comes up with the preceding dam block 5 when the guide rods 19 mounted on the succeeding dam block 5 engages with the toothed wheel 32, thus eliminating a gap g which has existed between these dam blocks before the engagement therebetween.

Figure 10:
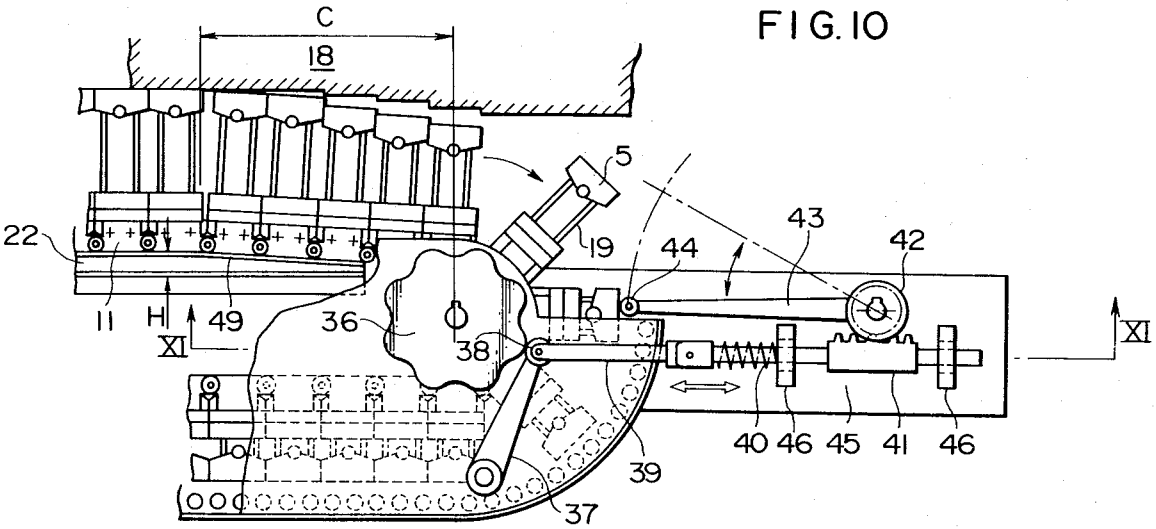
FIG. 10 is a sectional plan view of still another embodiment in which a casting machine according to the present invention is improved in structure on the outlet side.
Figure 11:
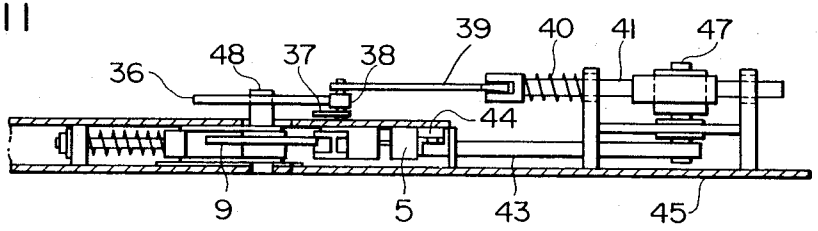
FIG. 11 is a sectional side elevation taken along a line XI —XI of FIG. 10.

FIG. 10 shows a modified arrangement providing on the mold outlet side a mechanism which enables the dam blocks to be securely set back before entering the returning route and to be smoothly revolved at the mold outlet by evading the edge of each step on the surface of a cast piece formed when the width of the cast piece is altered. FIG. 11 is a side elevation of this mechanism provided around the outlet side sprocket wheel 9. A cam plate 36 which rotates integrally with the outlet side sprocket 9 is fixed to the end of the rotating shaft of this sprocket 9. The number of lobes of the cam plate 36 is equal to the number of teeth of the sprocket 9. A cam follower 38 is attached to the top of a swinging arm 37 which is pressed against a cam lobe of the cam plate 36 by a reciprocating rod 39 which is urged by a spring 40 and guided by a bearing 46 attached to a frame 45. A rack 41 is attached to the other end of the reciprocating rod 39. The base portion of a swinging rod 43 is fixed to the shaft of a pinion 42 engaging with the rack 41, and a roller 44 is attached to the top of this swinging rod 43. In this mechanism, the swinging rod 43 goes and returns by making a given angle every time the sprocket 9 rotates by an amount corresponding to one tooth thereof, thus moving in synchronized relationship with the motion of the dam blocks 5 which is revolving with the sprocket wheel 9. When the dam block 5 revolves with its guide rods 19 fully pulled out, the roller 44 is brought to the position such as to facing the front surface of the dam block 5, and the dam block 5 is pushed in by the swinging motion of the swinging rod 43 and is completely pushed to the setback position when this swinging motion is finished. The dam block 5 is compulsorily returned from the projected position to the setback position when transferred from the advancing route to the returning route, thus functioning securely as compared with the above-described method using a sequence of guide rollers.

Referring now to FIG. 10, the chain guide 22 forms a slanted surface 49 which is slanted at the area C defined upstream of the outlet side sprocket 9 in such direction as to deviate far from the center axis of the mold. The axis of rotation of the outlet side sprocket 9 is offset by an amount corresponding to a deviation H occurring in the transverse direction of the mold in accordance with the form of the slanted surface. Accordingly, it is possible for the dam blocks to be revolved by evading the edge of each step on the side surface of a cast piece formed when the dam blocks is moved such as to reduce the width of the the case piece.

The present invention has been described with reference to these preferred embodiments, but it is not limited to these. Other modifications and alterations are also applicable when they are made without departing from the scope and spirit of the present invention set forth in the appended claims.

What is claimed is:

1. An endless track continuous casting machine comprising:

a pair of upper and lower endless belts having surfaces facing each other in a spaced apart relationship and travelling in a downwardly slanted direction;

a pair of sprockets disposed at each side of said endless belts, each sprocket of each pair of sprockets being spaced from each other in the longitudinal direction of travel of said endless belts and each sprocket rotating around an axis perpendicular to the surfaces of said endless belts;

a pair of endless chains, each endless chain formed by a plurality of connected links and rotating around one of said pair of sprockets;

a dam block mounted on each of said links on each side of said endless belts and together with said endless belts defining a mold for casting a cast piece there between, each of said dam blocks being pinched and supported between edges of said pair of endless belts and travelling with said pair of endless belts along a path advancing, from an inlet side of said mold to an outlet side of said mold, supporting means for supporting each of said dam blocks on a corresponding one of said links such as to enable each dam block to be movable in a direction perpendicular to each link;

guiding means disposed on the inlet side of said mold and guiding each dam block in accordance with the advancing movement of each of said endless chains such as to gradually increase the distance between each dam block and its corresponding link;

fixing means for fixing each of said dam block supporting means relative to said corresponding one of said links when each said dam block is pinched and supported between said pair of endless belts; and adjusting means for controlling said guiding means to adjust the increased distance between each said dam block and its corresponding link, thereby adjusting the width of said mold as defined between said dam blocks on each side of said endless belts while said pair of endless chains are moving.

2. An endless track continuous casting machine according to claim 1, wherein said supporting means includes a guide rod projecting rearwardly from the rear surface of each of said dam blocks and a guide rod bearing attached to each of said links forming said pair of endlesss chains each said guide rod bearing having a hole into which said guide rod of a corresponding dam block is inserted and said fixing means includes a rubber seal attached to said guide rod bearing and adapted to be compressed between said edges of said pair of endless belts, an aperature in said rubber seal and a double-split resilient sleeve in said aperature and receiving said guide rod whereby said double-split resilient sleeve is pinched against said guide rod when said rubber seal is compressed between said edges of said pair of endless belts.

3. An endless track continuous casting machine according to claim 1, wherein said guiding means includes:

a guide rail at each side of said mold and a guide roller attached to each of said dam blocks and adapted to roll on said guide rail, said guide rail having a first portion slanted toward the advancing direction of said mold to gradually approach the center axis of said mold and a second portion parallel with said center axis and a second portion parallel with said center axis of said mold, said second portion of said guide rail being reciprocably movable toward and away from said center axis, and said first portion of said guide rail being connected to said second portion such that its angle of inclination is altered in accordance with said reciprocative movement of said second portion of said guide rail.

4. An endless track continuous casting machine according to claim 2, further comprising a toothed wheel rotating at a tangential velocity higher than the moving velocity of said pair of endless belts and having a tooth profile to engage with a guide rod supporting each dam block immediately before said dam block is pinched between said pair of upper and lower endless belts on the inlet said of said mold.

5. An endless track continuous casting machine according to claim 4, wherein said toothed wheel is driving by a torque motor.

6. An endless track continuous casting machine according to claim 1, further comprising a dam block pushing means which pivotally moves in linked relationship with a sprocket located at the outlet side of said mold and which engages with a mold defining surface of each dam block revolving away from said pair of endless belts on the mold outlet side thereby pushing each block to a setback position.

7. An endless track continuous casting machine according to claim 6, wherein said pushing means includes:

a cam plate rotating in synchronized relationship with said sprocket located at said outlet side of said mold, said cam plate having cam lobes corresponding to the number of teeth of said sprocket;

a reciprocating rod having at one end a cam follower engaging with said cam lobes and having a rack at the other end and a swinging rod fixed at its one end to a pinion engaging with said rack and having at the other end a roller engaging with and rolling on the mold defining surface of each said revolving dam block.

8. An endless track continuous casting machine according to any one of claims 1 to 7, further comprising a chain guide disposed adjacent one side of said mold and having a first portion parallel with the center axis of said mold and on which rollers attached to each of said links forming said endless chain roll, said chain guide having a second portion slanted near the outlet side of said mold to gradually deviate from the center axis of said mold, the rotational axis of a sprocket located at the outlet side of said mold being shifted such that said sprocket engages with each of said links of said endless chain as delivered from said second slanted portion of said chain guide.

* * * * *